United States Patent [19]

Houghton

[11] Patent Number: 4,730,577

[45] Date of Patent: Mar. 15, 1988

[54] STEAM GENERATOR FOR THERMAL RECOVERY SYSTEM

[75] Inventor: John D. Houghton, Friendswood, Tex.

[73] Assignee: Shell California Production Inc., Houston, Tex.

[21] Appl. No.: 563,915

[22] Filed: Dec. 21, 1983

[51] Int. Cl.[4] ..... F22B 1/02

[52] U.S. Cl. ..... 122/33; 122/34; 122/488

[58] Field of Search ..... 122/31 R, 33, 34, 35, 122/40, 488

[56] References Cited

U.S. PATENT DOCUMENTS

| | | | |
|---|---|---|---|
| 1,677,798 | 7/1928 | Ruths | 122/35 |
| 2,160,619 | 5/1939 | Larrecq | 122/488 |
| 2,182,428 | 12/1939 | Hadmark | 122/31 R |
| 3,315,645 | 4/1967 | Linnersten | 122/33 |
| 3,544,424 | 12/1970 | Mayer et al. | 122/34 |
| 4,074,660 | 2/1978 | Tsao | 122/34 |
| 4,222,350 | 9/1980 | Pompei et al. | 122/33 |
| 4,275,563 | 6/1981 | Kuroda et al. | 122/31 R |
| 4,424,770 | 1/1984 | Yamazaki et al. | 122/488 |
| 4,429,662 | 2/1984 | Hashizume | 122/34 |

*Primary Examiner*—Henry C. Yuen

[57] ABSTRACT

A system and method for producing steam for use in a thermal recovery process for crude oil. The system is particularly useful in combination with a cogeneration plant that produces high temperature process steam. The system uses a central steam drum-separating unit surrounded by a plurality of once-through heat exchangers.

5 Claims, 1 Drawing Figure

STEAM GENERATOR FOR THERMAL RECOVERY SYSTEM

RELATED APPLICATION

This application is related to co-pending application Ser. No. 494,145 filed May 12, 1983, and entitled "Once-Through Steam Generator", now U.S. Pat. No. 4,474,011.

BACKGROUND OF THE INVENTION

The present invention pertains to generating low quality steam containing dissolved solids for use in a thermal recovery process of crude oil and particularly to a cogeneration system for producing the low quality steam. Once of the most successful methods for recovering heavy crude oil has been the use of steam to heat the formation to reduce the viscosity of the oil and permit it to be pumped from the reservoir. Various processes for steam thermal recovery have been developed such as steam flood where steam is injected into one well to drive the crude oil to a second or production well. Another is a steam soaking method in which the steam is injected into one well for a time with the well then being shut in to permit the steam to heat the formation after which the well is produced to remove the crude oil. All of these methods require a large amount of steam that requires a corresponding large quantity of water. Of course, some water is recovered with the produced crude oil but a large quantity of water remains in the formation. Since a large number of heavy oil formations are located in areas where fresh water supplies are limited, the practice has developed of using brackish water containing a large quantity of dissolved salts for forming the steam. To prevent the salts from forming scale on the exchanger during the steam formation phase, it has been customary to use low quality steam, for example, 80–85% steam. The salts remain dissolved in the remaining 15–20% or water phase of the steam. For this system to operate satisfactorily, it has been necessary to design the heaters for producing the steam using a single continuous flow path for the water. This ensures that the quality of the steam is maintained at the desired level and at no point in the heater does the steam become substantially dry steam, which would cause depositing of the salts as scale on the heating surfaces.

The above described system is utilized extensively and all of the heaters are either fired with natural gas or oil. In recent years the price of natural gas and/or oil has increased to a level that seriously affects the economics of the thermal recovery process. In addition, various regulatory measures have been passed in an attempt to conserve natural gas for other uses than firing heaters. Thus, it has become desirable to look at alternate fuels for producing the steam for thermal recovery processes.

An alternate fuel that could be used to fire the heater is, of course, coal. While coal could be used, the present practice of a large number of relatively small heaters does not lend itself to coal firing. Further, efficiencies that could be achieved with coal firing of the present heaters would be low compared to what can be achieved in large central power plants.

Central power plants can be designed to burn coal and achieve a high efficiency. Also cogeneration plants have been developed that provide electricity and steam for use in various processes while maintaining a high efficiency. The process steam is high quality steam that is condensed and can be used as feed water for the boiler. This is not possible in thermal recovery systems since the water used to form the steam is brackish and would quickly foul the high efficiency boilers. Thus, heat exchangers must be used to generate the thermal recovery steam.

A suitable heat exchanger is described in co-pending application Ser. No. 494,145 entitled "Once-Through Steam Generator". The application describes a heat exchanger having multiple, continuous flow paths between the inlet and outlet. This heat exchanger design allows the use of brackish water but is difficult to build. The exchanger requires U-bends at the end of each tube pass to form a continuous flow path. This adds to the complications and cost of building the heat exchanger.

SUMMARY OF THE INVENTION

The present invention solves some problems of the heat exchanger disclosed in the co-pending application by providing a plurality of once-through heat exchangers. By using a plurality of heat exchangers they can be made relatively compact yet provide the required surface area for the heat transfer in a single pass heat exchanger. The individual heat exchangers are all connected to a common steam drum separator unit, for example, six to eight individual heat exchangers may be connected to a single steam drum separator unit. The steam drum provides a reservoir of water for feeding individual heat exchangers as well as a separation means for separating the moisture from the steam which is supplied to the thermal recovery units. The use of the individual heat exchangers allows the construction of heat exchangers following normal practice and eliminates the need for U-bends to provide a continuous flow path as required in the co-pending application. This greatly simplifies the construction of the heat exchangers and reduces the overall cost of the system.

The water in the steam drum separating unit may be circulated through the individual heat exchangers by thermal convection or if necessary, pumps may be used to ensure sufficient circulation. Also, provisions are made for blowing down the steam drum separator unit to remove solids that may accumulate to prevent undue concentration of solids from the brackish water in the steam drum separator unit. The blow down line may also include a pump to generate sufficient pressure so that the water solids concentration can be combined with the steam that is drawn off the top of the steam drum separator unit.

BRIEF DESCRIPTION OF THE DRAWING

The present invention will be more easily understood from the attached drawing showing an elevation view of a heat exchanger system constructed according to the present invention.

The FIGURE shows a heat exchanger steam drum combination constructed according to this invention.

DESCRIPTION OF THE PREFERRED EMBODIMENTS

Figure 1:
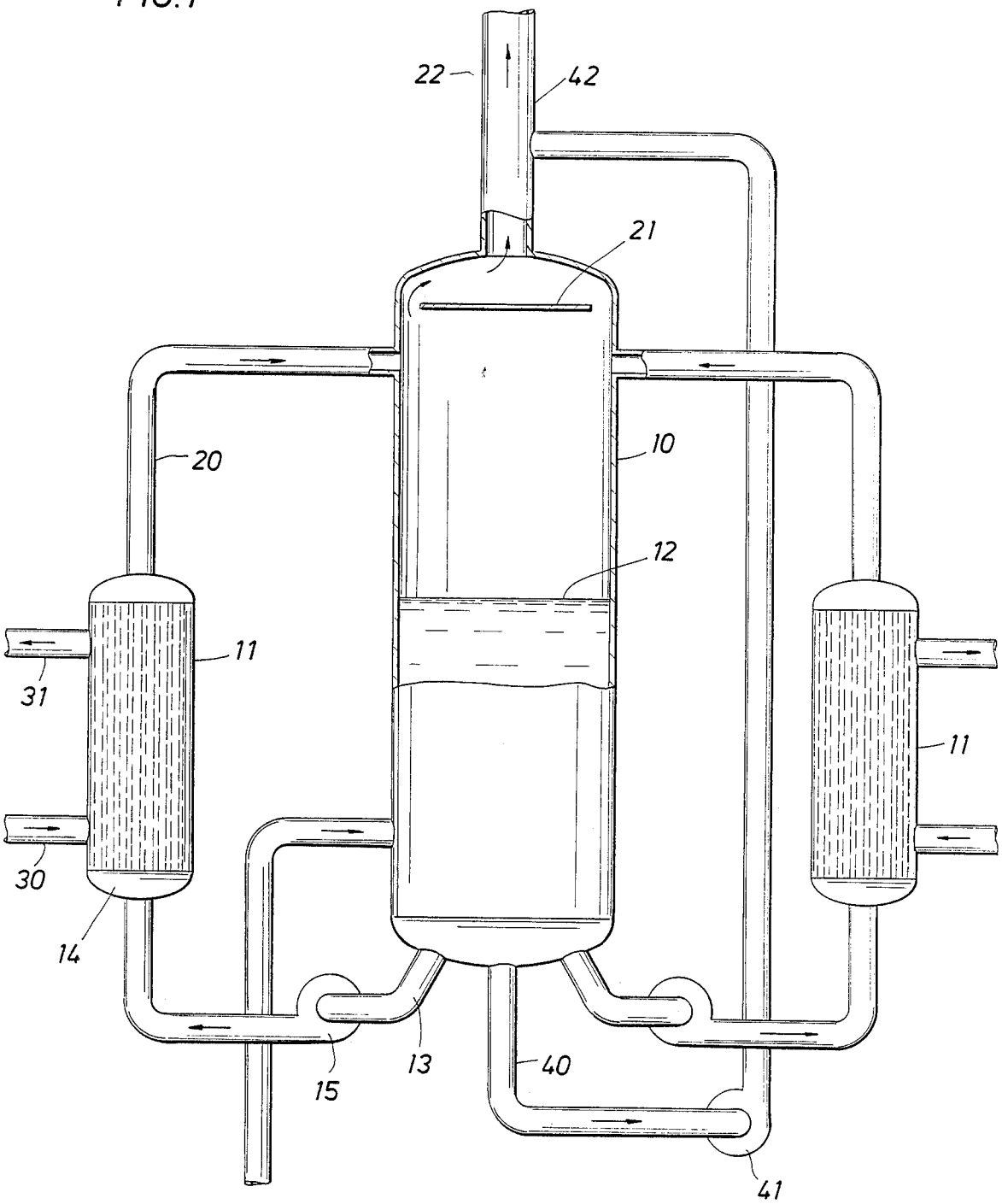

Referring to the attached drawing there is shown a steam drum separator unit 10 which is surrounded by a plurality of individual heat exchanger units 11. For example, six to eight heat exchanger units may be used with a single steam drum separator unit although the number will depend upon the thermal process steam that is to be generated as well as the steam conditions desired. The steam drum contains water, for example, up to the level 12 which is used to supply the water to the individual heat exchangers with the water being supplied through a conduit 13 to the bottom 14 of the individual exchangers. Normally, thermal convection can be used to provide the necessary circulation between the steam drum to the exchangers and back to the steam drum although, in some cases, it may be necessary to use a pump 15 to supply the necessary circulation, particularly in cases where high flow rates and heat transfer rates are required.

The steam exits from the top of the vertical exchangers and passes out the line 20 into the top of the steam drum. From the top of the steam drum the steam must pass around suitable separating units such as the baffle 21 before it can exit from the steam drum through the line 22. The separating units serve to remove the excessive moisture contained in the steam which then falls back into the bottom of the steam drum where it can be recirculated to the individual exchangers. The individual heat exchangers are supplied with steam which is bled from the turbines of a cogeneration plant or similar sources through a line 30. The steam exits from the exchangers through the line 31 back to the cogeneration plant where it can be used for additional heat exchangers or condensed to supply feed water for the boilers.

The blow down line 40 and pump unit 41 are provided for periodically blowing down the steam drum to reduce the solids concentration in the water contained therein. The blow down discharge from the pump is supplied back to the outlet steam line 22 where the water can combine with the steam and be carried with the steam into the formation. In place of recirculating the solids to the steam line, the blow down can be discharged into a suitable disposal area if desired.

Since the heat exchange takes place in a single pass through the individual heat exchange units 11 the solids contained in the brackish feed water will not be deposited as scale on the heat exchanger tubes. The heat exchangers are designed to produce 80–85 percent quality steam with the solids contained in the wet steam that exits from the top of the individual units. Of course, both the flow rate of the bleed steam and water through the heat exchangers must be maintained at controlled levels to ensure that the steam quality is maintained. Even though separators are used to provide relatively dry steam the solids will concentrate in the steam drum 10 and not in the heat exchangers. While the solids are concentrated in the water in the steam drum, the solids will not be condensed and form scale on the steam drum since there is sufficient water in the steam drum to maintain them in solution. Further, by periodically blowing down the steam drum the concentration of solids can be maintained within reasonable limits.

The use of individual heat exchangers provides not only simplified construction but also additional reliability. The individual exchangers can be removed from service for repair of tube leaks and similar malfunctions while substantially full capacity of the system is maintained. Since the steam drum separating unit 10 contains no tubes and is of simplified construction, it is relatively maintenance free.

What is claimed is:

1. A system for producing steam in a cogeneration plant for use in a thermal recovery process for crude oil using brackish water, said system comprising:

a central steam drum-separator unit;

a plurality of once-through shell and tube type heat exchangers, said heat exchangers surrounding said steam drum-separator unit, said brackish water circulating through the tubes of said heat exchangers;

conduit means for coupling the tube side of each of said heat exchangers to both the top and bottom portions of the steam drum-separator unit;

circulation means disposed to establish circulation between the steam drum-separator unit and each of said heat exchangers;

means for circulating steam from the cogeneration plant through the shell side of the heat exchangers; and means for maintaining the liquid level in the steam drum-separator unit within preset limits.

2. The system of claim 1 wherein the steam drum-separator unit and heat exchangers have an elongated cylindrical shape and are mounted vertically.

3. The system of claim 2 wherein natural forces are used to circulate the water from the steam drum-separator unit to the individual heat exchangers.

4. The system of claim 1 wherein excess water in the steam drum-separator unit is added to the steam produced by the heat exchangers.

5. A method for producing thermal recovery steam in a cogeneration plant, said method comprising:

circulating steam from the cogeneration plant through the shell side of at least one heat exchanger;

withdrawing water from a steam drum-separator unit and circulating it through the tube side of the at least one heat exchanger to produce thermal recovery steam;

returning the thermal recovery steam formed on said tube side of the heat exchanger to the steam drum-separator unit;

separating the thermal recovery steam from the water in the steam drum-separator unit and withdrawing the thermal recovery steam from the steam drum-separator unit; and withdrawing at least a portion of the water from the bottom of the steam drum-separator unit and recombining it with the steam from the steam drum-separator unit.

* * * * *